United States Patent [19]

Mirsberger

[11] Patent Number: 4,662,992

[45] Date of Patent: May 5, 1987

[54] TWIN-WIRE PAPERMAKING MACHINE AND METHOD OF DEWATERING A PAPER WEB IN A TWIN-WIRE PAPERMAKING MACHINE

[75] Inventor: Peter Mirsberger, Berg, Fed. Rep. of Germany

[73] Assignee: Sulzer-Escher Wyss GmbH, Ravensburg, Fed. Rep. of Germany

[21] Appl. No.: 734,784

[22] Filed: May 16, 1985

[30] Foreign Application Priority Data

May 25, 1984 [CH] Switzerland ..... 2582/84

[51] Int. Cl.[4] ..... D21F 11/00

[52] U.S. Cl. ..... 162/203; 162/205; 162/207; 162/290; 162/297; 162/301; 162/305; 162/308; 162/317; 162/358

[58] Field of Search ..... 162/203, 205, 207, 290, 162/301, 305, 306, 308, 317, 358, 361, 297

[56] References Cited

U.S. PATENT DOCUMENTS

| | | | |
|---|---|---|---|
| 3,097,994 | 7/1963 | Dickens et al. | 162/308 |
| 3,438,852 | 4/1969 | Ely | 162/203 |
| 3,945,881 | 3/1976 | Speidel | 162/290 |
| 3,996,098 | 12/1976 | Kankaanpaa | 162/301 |
| 4,056,433 | 11/1977 | Koponen et al. | 162/290 |

FOREIGN PATENT DOCUMENTS

| | | | |
|---|---|---|---|
| 867793 | 7/1949 | Fed. Rep. of Germany | 162/305 |
| 710907 | 6/1954 | United Kingdom | 162/207 |

*Primary Examiner*—Peter Chin

*Attorney, Agent, or Firm*—Werner W. Kleeman

[57] ABSTRACT

In a particularly simple construction a twin-wire papermaking machine possesses a reduced number of rolls as well as a compact arrangement. The foregoing and the greatest possible velocity of a through-passed paper web can be obtained by employing non-suction rolls, instead of suction rolls, in a pressing section of such papermaking machine, by upwardly entraining the paper web conjointly with a top or upper wire of a twin wire arrangement and by transferring the paper web to a pressing roll having a smooth surface, and furthermore, by providing at the pressing roll an extended or wide-nip supporting shoe by means of which the paper web is dewatered in an extended pressing nip zone. Advantageously, the dewatered paper web is taken off from the surface of the pressing roll in a downward direction and fed to a drying section of the papermaking machine. The drying section may be arranged below the pressing section and directly adjacent the bottom or lower wire of the twin wire arrangement. There is thus obtained a particularly compact construction.

38 Claims, 3 Drawing Figures

TWIN-WIRE PAPERMAKING MACHINE AND METHOD OF DEWATERING A PAPER WEB IN A TWIN-WIRE PAPERMAKING MACHINE

BACKGROUND OF THE INVENTION

The present invention relates to a new and improved construction of a twin-wire papermaking machine and also relates to a new and improved method of dewatering a paper web in a twin-wire papermaking machine.

In its more particular aspects, the present invention specifically relates to a new and improved construction of a twin-wire papermaking machine containing a top or upper wire or screen and a bottom or lower wire or screen, each of which is guided in an endless loop at related guide rolls. The endless loops have a common section in which the top and bottom wires or screens form a twin-wire arrangement which passes at least one sheet or web forming roll. A paper web is formed between the twin-wire arrangement from a fiber stock suspension delivered by a headbox and such formed paper web is guided to a pressing roll at which the paper web is dewatered.

In a twin-wire or double-screen papermaking machine as described, for example, in U.S. Pat. No. 4,116,763, granted Sept. 26, 1978, and U.S. Pat. No. 4,176,005, granted Nov. 27, 1979, the sheet or web forming rolls are preferably constructed as open rolls. The paper web, after separation of the two wires or screens, is withdrawn in an approximately horizontal direction either from the top or upper wire or from the bottom or lower wire. Thereafter, the paper web, if desired, with the interposition of a take-off roll, is transferred to a felt web and fed to a pressing section which generally contains one or a number of suction rolls. In such arrangement a pressing roll cooperates with at least one, generally with a number of counter rolls. The paper web is thus dewatered under the action of a line-shaped pressing force and such dewatering operation is assisted by the felt web. As a result, the paper web can be subsequently fed to a drying section of the papermaking machine, and this drying section is provided consecutive to the pressing section.

In the presently required high-speed operation of such papermaking machines, i.e. at high travel speeds of the paper web, the employment of suction rolls as well as the series-arrangement of a number of pressing nips hitherto has been deemed indispensable in order to obtain safe web guidance and a sufficiently efficient mechanical dewatering process in the pressing section. However, suction rolls are expensive and cost-intensive machine elements in terms of manufacture as well as in terms of maintenance. Furthermore, a wire or screen section, the pressing section and the drying sections had to be series-arranged in the known papermaking machines, with the undesirable result that there prevailed considerable total or overall dimensions of the papermaking machine.

SUMMARY OF THE INVENTION

Therefore, with the foregoing in mind, it is a primary object of the present invention to provide a new and improved construction of a twin-wire papermaking machine which is not afflicted with the aforementioned drawbacks and limitations of the prior art constructions heretofore discussed.

It is a further important object of the present invention to provide a new and improved construction of a twin-wire papermaking machine which is further developed, particularly with respect to the wire or screen section and the pressing section thereof, and which does not require any complicated machine elements which are expensive, particularly with respect to their maintenance.

Another significant object of the present invention aims at a new and improved construction of a twin-wire papermaking machine which possesses a reduced number of rolls and reduced total dimensions, so that a twin-wire papermaking machine of a compact structure is obtained.

Now in order to implement these and still further objects of the invention, which will become more readily apparent as the description proceeds, the twin-wire papermaking machine of the present development is manifested by the features that, the top or upper wire, after separation from the bottom or lower wire, entrains the paper web substantially in an upward direction. The paper web is transferred from the top wire to the pressing roll at a transfer location. The pressing roll is structured as a non-suction roll with a smooth circumferential or outer surface. There is further provided a pressing or supporting shoe which extends over part of the smooth circumferential surface of the pressing roll and forms conjointly therewith an extended pressing nip zone through which the paper web is passed and thereby dewatered during the operation of the twin-wire papermaking machine.

As alluded to above, the invention is not only concerned with the aforementioned apparatus aspects, but also relates to an improved method of dewatering a paper web in a twin-wire papermaking machine. To achieve the aforementioned measures, the inventive method comprises the following steps:

(a) upwardly entraining the paper web by the top or upper wire after the twin wires have been separated from each other, (b) transferring the paper web from the top or upper wire to the pressing roll, (c) providing as the pressing roll a non-suction roll possessing a smooth circumferential surface, and (d) dewatering the paper web in an extended pressing nip zone which is formed by the pressing roll and a pressing or supporting shoe extending over part of the circumferential surface of the pressing roll.

It is of particular advantage when the paper web is directly transferred from the top or upper wire to the smooth circumferential surface of the pressing roll.

Preferably, the dewatered paper web, after exiting from the pressing nip zone, is downwardly guided from the pressing roll to a drying section, preferably to a first drying cylinder thereof which is arranged below the pressing roll and adjacent the bottom or lower wire.

As a result of the coaction of the aforementioned features of the inventive apparatus and as a result of the coaction of the aforementioned method steps of the invention, there is obtained in high-speed operating papermaking machines this type, i.e. at high paper web speeds, despite a smaller number of rolls and without the necessity of using suction rolls, a safe web guidance and an improved dewatering result. Additionally, and due to the specific arrangement of the components there is obtained a papermaking machine of a compact construction and which has comparatively smaller total overall dimensions and possesses a simplified roll stand or frame. The roll stand or frame may even constitute a common structure for the wire or screen section and for the pressing section of such papermaking machine.

It is a further advantage of the inventive construction of the twin-wire papermaking machine that there are avoided open or unsupported runs of the paper web, so that the paper web is stretched or extended only to a minimum degree.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
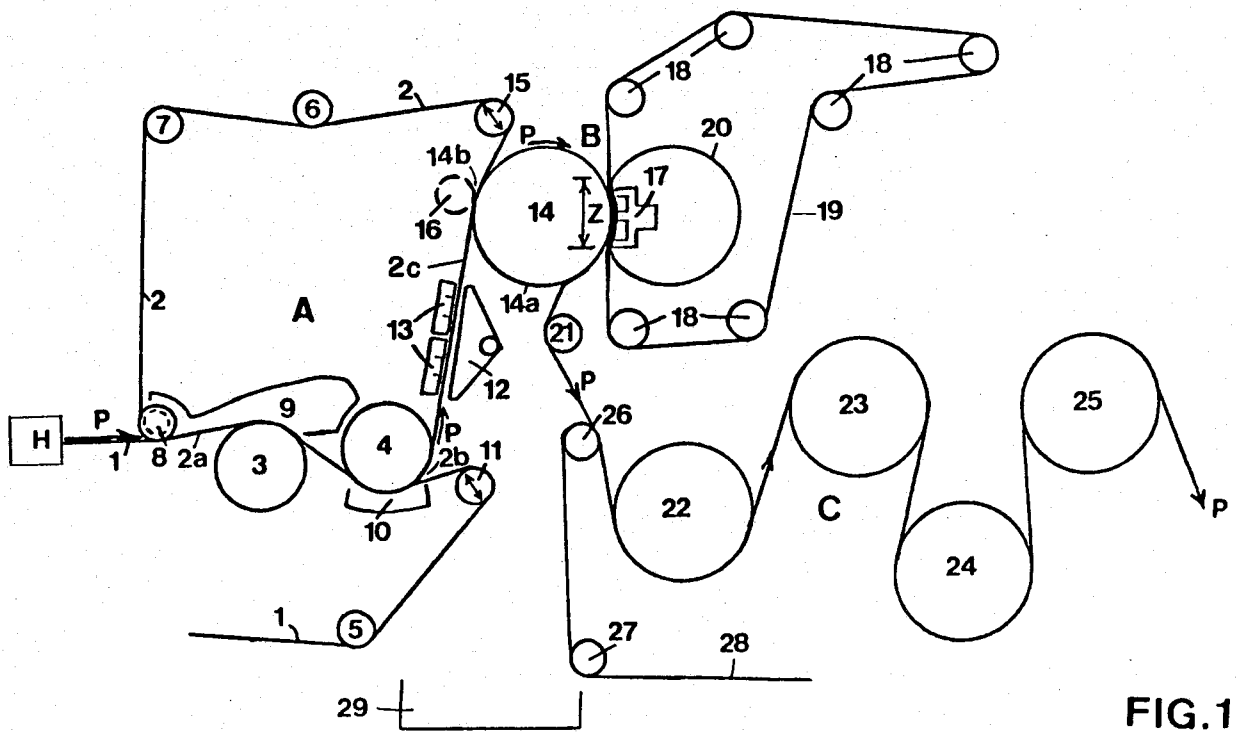
FIG. 1 is a schematic illustration of a first embodiment of the inventive twin-wire papermaking machine.

Describing now the drawings, it is to be understood that only enough of the construction of the twin-wire papermaking machine has been shown as needed for those skilled in the art to readily understand the underlying principles and concepts of the present development, while simplifying the showing of the drawings. Turning attention now specifically to FIG. 1 of the drawings, there is schematically illustrated therein a first exemplary embodiment of the inventive twin-wire papermaking machine comprising a wire or screen section or dewatering section A, a pressing section B and a consecutively arranged drying section C.

The dewatering section or wire or screen section A contains a bottom or lower wire 1 and a top or upper wire 2, each of which comprises a wire or screen or any other suitable liquid pervious structure defining web-carrying means and each of which forms an endless loop of such wire or screen. The top wire 2 may be structured, for example, as a simple plastic screen or mesh or may constitute a felt web. The endless loops of the bottom or lower wire 1 and the top or upper wire 2 form a common twin-wire section or arrangement 2*a* which is passed over at least one, in the illustrated embodiment two dewatering rolls which constitute sheet or web forming rolls 3 and 4. The sheet or web forming rolls 3 and 4 are constructed as solid rolls but, if desired, they can also be provided with an open, i.e. interrupted or non-smooth surface.

Additionally, the sheet or web forming roll 4 constitutes at least part of separating means and performs the function of separating, at a predetermined separating location 2*b*, the bottom wire 1 and the top wire 2 which previously formed the twin wire section or arrangement 2*a*. Guide rolls 5, 6 and 7 are provided to guide the bottom wire 1 and the top wire 2 in their related endless loops. Additionally, there is provided a displaceable directing or control roll 11 which also is part of the aforementioned separating means and which assists in or controls the separation of the bottom wire 1 from the top wire 2. A further displaceable directing or control roll 15 is operatively associated with the pressing roll 14 which consitutes a single pressing roll and its function will be described in more detail hereinbelow.

The fiber stock suspension for forming the paper web P issues from an only schematically indicated headbox H and the formed paper web P is fed by means of the bottom wire 1 to a sheet or web forming zone which is mainly defined by the twin-wire section or arrangement 2*a*. Such sheet or web forming zone starts at a control or guide roll 8 which has an open, for example, a grooved or fluted surface. In the sheet or web forming zone the paper web P is fed to the two dewatering or web forming rolls 3 and 4. Related catch containers 9 and 10 for collecting thrown-off liquid are provided for the dewatering or web forming rolls 3 and 4.

Following the last dewatering or web forming roll in the sequence, namely the dewatering or web forming roll 4, the bottom wire 1 and the top wire 2 which up to the predetermined separation location 2*b* formed the twin-wire section or arrangement 2*a* in the dewatering section or sheet or web forming section A of this embodiment of the twin-wire papermaking machine, are separated from each other by means of the displaceable wire separation control roll 11. This displaceable wire separation control roll 11 is arranged in such a manner that the paper web P is upwardly entrained by the top wire 2 i.e. by an upwardly directed top wire section 2*c*, after the bottom wire 1 and the top wire 2 have been separated from each other. A steam box 12 is arranged intermediate the wire separating means constituted by the displaceable wire separation control roll 11 and the pressing roll 14. The paper web P passes through the steam box 12 by means of which the paper web P is thus heated. The steam box 12 is arranged on the side of the top wire 2 or upwardly directed top wire section 2*c* on which the paper web P is entrained. On the opposite side of the top wire 2 or upwardly directed top wire section 2*c* and at the level of the steam box 12 there are arranged suction boxes 13 which constitute means for effecting additional dewatering of the paper web P.

Subsequently the paper web P is directly transferred to the pressing roll 14 at a predetermined transfer location 14*b*. This direct transfer of the paper web P is effected without the assistance of a felt web and is accomplished exclusively due to the action of the tension of the top or upper wire 2. The single pressing roll 14 constitutes a non-suction solid roll possessing a smooth circumferential or outer surface 14*a*. The direct transfer of the paper web P from the top wire 2 or upwardly directed top wire section 2*c* to the smooth surface 14*a* of the pressing roll 14 is made possible due to the fact that the paper web P still has a certain water content which is required for the transfer to this smooth surface 14*a* of the pressing roll 14. For this purpose the dry content of the paper web P should not substantially exceed a value of 25%.

The separation or transfer of the paper web P from the top wire 2 or upwardly directed top wire section 2*c* is additionally assisted by the aforementioned further displaceable control roll 15. Particularly at high paper web speeds the web transfer from the top wire 2 or upwardly directed top wire section 2*c* to the pressing roll 14 can be facilitated by additionally providing a web transfer roll 16 at the web transfer location 14*b* at which the paper web P is separated or taken off from the top wire 2 or upwardly directed top wire section 2*c* and transferred to the pressing roll 14. This transfer roll 16 makes the paper web P adhere more readily to the smooth circumferential or outer surface 14*a* of the pressing roll 14.

The pressing section B of the first exemplary embodiment of the inventive twin-wire papermaking machine contains a single pressing nip which is formed by the pressing roll 14 possessing the aforementioned smooth circumferential surface 14*a*, and a pressing or supporting shoe 17 which extends along part of the circumference of the pressing roll 14 and which forms conjointly therewith an extended pressing nip zone Z. The paper web P is passed through the extended pressing nip zone Z along a predetermined passage direction. During such paper web passage the pressing or supporting shoe 17 presses the paper web P conjointly with a felt web 19, which is guided at guide rolls 18, along with a flexible band or cover 20 against the surface of the pressing roll 14 in the region of the extended pressing nip zone Z and thereby dewaters the paper web P.

The pressing or supporting shoe 17 may be designed in a manner known as such as a hydrostatic support element or as a series of a number of such hydrostatic support elements such as known, for example, from U.S. Pat. No. 3,783,097, granted Jan. 1, 1974, and U.S. Pat. No. 3,974,026, granted Aug. 10, 1976. The pressing or supporting shoe 17, however, can also be designed as a wide-nip or extended supporting shoe. Furthermore, the pressing or supporting shoe 17 may also be constructed in such a manner that the pressing force increases in the passage direction of the paper web P through the extended pressing nip zone Z. The prolonged dewatering time which the paper web P experiences in the extended pressing nip zone Z is sufficient, particularly for paper possessing low unit area mass in order to obtain a high dry content comparable with the dry content otherwise obtained by using a number of line-shaped pressing nips.

After the extended pressing nip zone Z the paper web P follows the surface of the pressing roll 14 until it is taken off therefrom by means of a take-off or pick-up roll 21 and is further downwardly fed to the drying section C of the twin-wire papermaking machine.

The aforementioned drying section C contains a number of heatable drying cylinders 22 to 25. The paper web P is passed over the surfaces of the drying cylinders 22 to 25 conjointly with a drying wire or screen 28 which is guided by guide rolls 26 and 27. The paper web P is thereby subjected to a final drying operation. A couch pit 29 is provided below the pressing section B, i.e. intermediate the dewatering section or screen or wire section A and the drying section C.

The upward entrainment of the paper web P by the top wire 2, the arrangement of the pressing roll 14 at the upwardly directed section 2*c* of the endless loop formed by the top wire 2, the further downward direction of the paper web P after leaving the extended pressing nip zone Z, and the arrangement of the first drying cylinder 22 of the drying section C below the pressing section B permits a compact structure of the twin-wire papermaking machine. As a consequence, the overall length of the inventive twin-wire papermaking machine can be maintained shorter than that of hitherto known papermaking machines. As a further consequence, the dewatering section or wire or screen section A, particularly the dewatering or sheet or web forming rolls 3 and 4 as well as the pressing section B containing the pressing roll 14, can be accommodated in a common roll frame or stand, and thereby the installation is considerably simplified and more favorable in terms of costs.

Guiding the paper web P along a winding or serpentine travel path at the dewatering or sheet or web forming rolls 3 and 4 increases the dewatering capacity in this dewatering section or wire or screen section A. The overall dewatering capacity is further increased by extending the pressing nip by employing the aforementioned pressing or supporting shoe 17 which forms the extended pressing nip zone Z in the pressing section B. Guiding the felt web 19 merely within the extended pressing nip zone Z laterally adjacent the pressing roll 14 furthermore permits outfeeding the paper web P from the pressing roll 14 in a downward direction. As a consequence, the drying section C can be arranged below the pressing section B and immediately adjacent the dewatering section or wire section A.

It is a further advantage that in the arrangement of the dewatering section or wire section A, the pressing section B and the drying section C as described hereinbefore, there is only required a single couch pit 29 or equivalent structure.

Due to the heretofore described measures, specifically due to the reduction in the number of rolls which are employed and due to the more simple roll construction, the entire installation is distinctly more favorable in terms of costs and less expensive with respect to maintenance.

Figure 2:
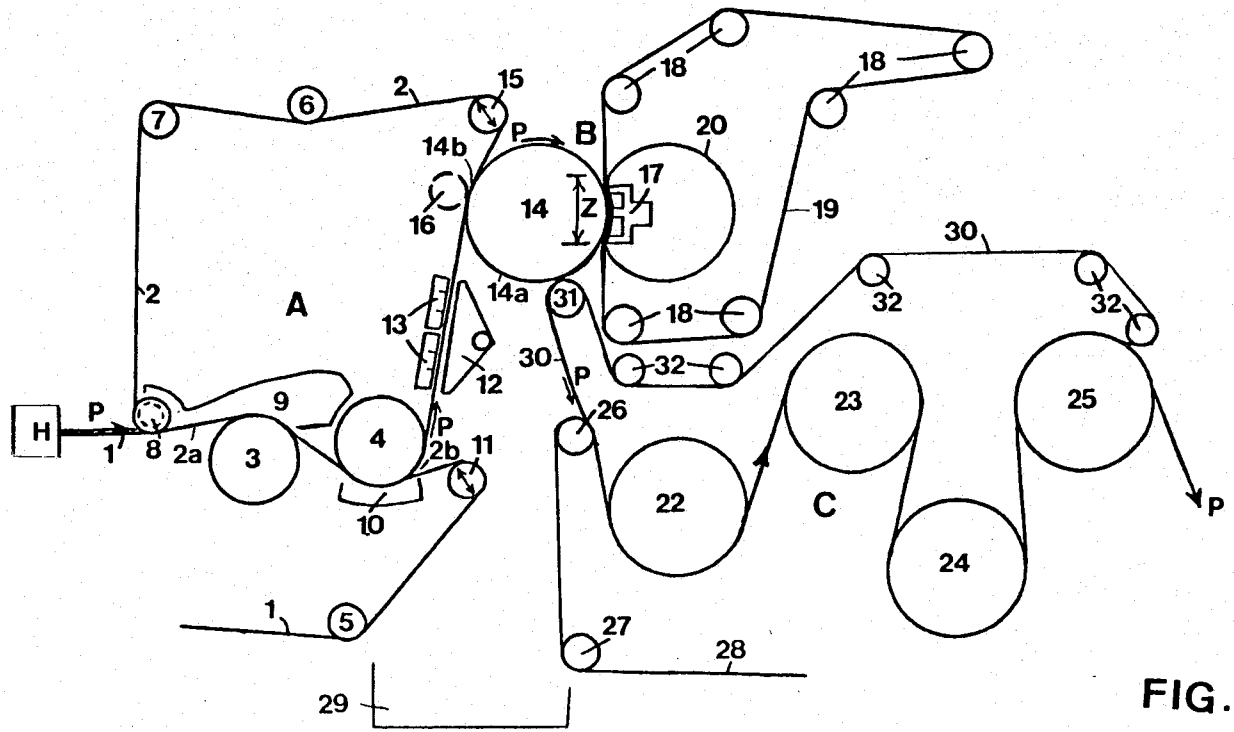
FIG. 2 is a schematic illustration of a second embodiment of the inventive twin-wire papermaking machine.

A second exemplary embodiment of the inventive twin-wire papermaking machine is schematically illustrated in FIG. 2 and constitutes a variant of the first embodiment described hereinbefore with reference to FIG. 1. In this second embodiment the paper web P is taken off from the pressing roll 14 by means of a take-off or pick-up roll 31 which is directly arranged at the pressing roll 14. The paper web take-off is thus effected without any free or unsupported run of the paper web P and in a closed guiding system by means of a drying mesh felt 30 which is guided by means of guide rolls 32. Also in this case there is obtained a simplified and compact arrangement and design of the twin-wire papermaking machine which is favorable in terms of costs. This second embodiment has the additional advantage that there are avoided open or unsupported runs of the paper web P, so that stretching or extension of the paper web P is kept at a minimum.

Figure 3:
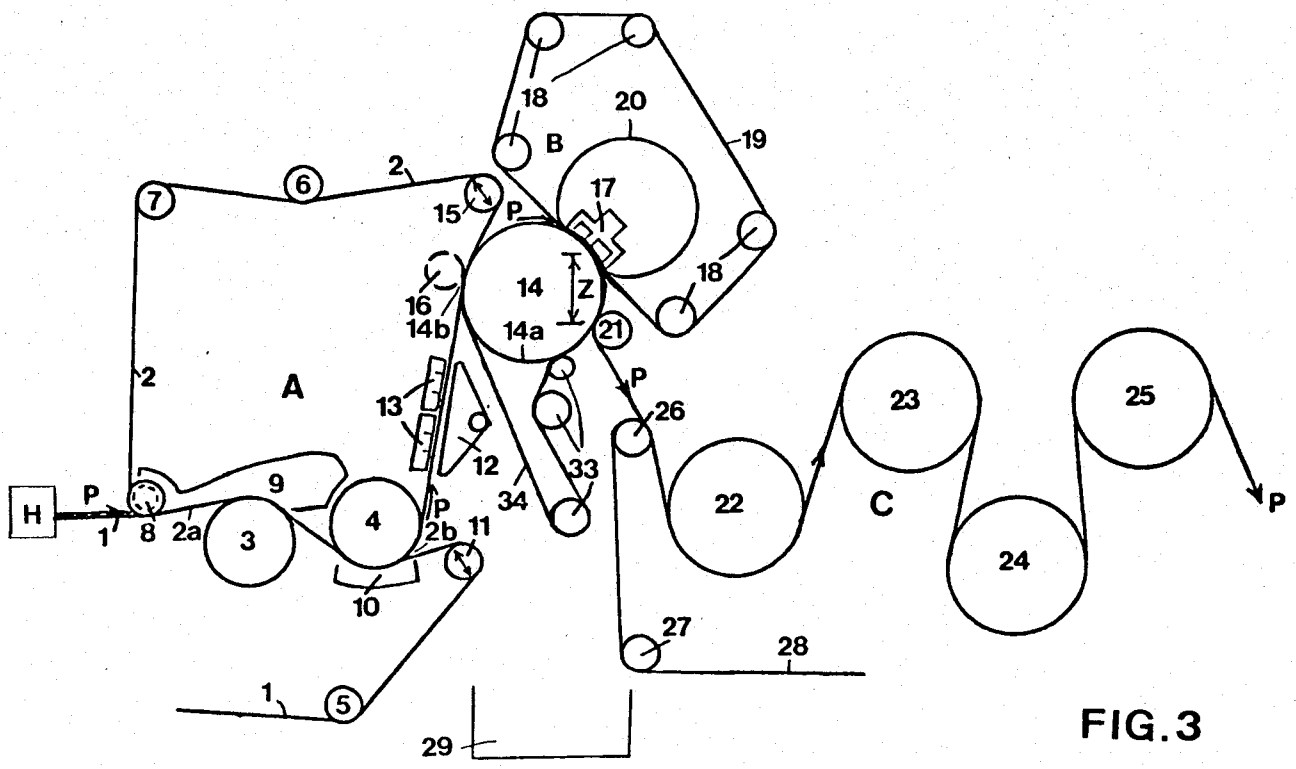
FIG. 3 is a schematic illustration of a third embodiment of the inventive twin-wire papermaking machine.

During the use of certain types of paper it may be preferable to guide the paper web P conjointly with a further felt web at the pressing roll 14. Such guidance of the paper web P at the pressing roll 14 is realized in the third exemplary embodiment of the inventive twin-wire papermaking machine illustrated in FIG. 3. An additional felt web 34 is guided at guide rolls 33 and is further guided conjointly with the paper web P after its transfer from the top wire 2 to the smooth circumferential surface 14*a* of the pressing roll 14 as well as through the extended pressing nip zone Z formed between the pressing or supporting shoe 17 and the pressing roll 14. Otherwise this third embodiment corresponds to the first embodiment described hereinbefore with reference to FIG. 1 and this third embodiment has analogous advantages.

It should be noted that the invention is not limited to the exemplary embodiments described hereinbefore, but that further modifications and developments are possible within the spirit and scope of the inventive concepts.

While there are shown and described present preferred embodiments of the invention, it is to be distinctly understood that the invention is not limited thereto, but may be otherwise variously embodied and practiced within the scope of the following claims. Accordingly,

What I claim is:

1. A twin-wire papermaking machine comprising:

a top wire and a bottom wire;

a predetermined number of guide rolls operatively associated with said top wire;

a predetermined number of guide rolls operatively associated with said bottom wire;

each said top wire and each said bottom wire being guided at said predetermined number of guide rolls to form an endless loop;

at least one dewatering roll;

said endless loops of said top wire and of said bottom wire being guided in such manner that a common twin-wire section is formed whch is guided at least along said at least one dewatering roll;

a headbox for feeding a fiber stock suspension to said twin-wire section for forming a paper web from said fiber stock suspension;

said twin-wire section and said at least one dewatering roll constituting a dewatering section of the papermaking machine;

separating means for separating said top wire and said bottom wire at a predetermined separating location following said twin-wire section;

said top wire, containing an upwardly directed top wire section following said separating means and extending substantially in an upward direction;

a pressing section cooperating with said upwardly directed top wire section;

said pressing section containing a single pressing roll following said predetermined separating location and being operatively associated with said upwardly directed top wire section at a predetermined paper web transfer location at which said paper web is directly transferred from said upwardly directed top wire section to said single pressing roll;

said single pressing roll constituting a non-suction roll provided with a substantially smooth circumferential surface;

said pressing section further containing a pressing shoe;

said pressing show extending over part of said substantially smooth circumferential surface of said single pressing roll and forming conjointly with said single pressing roll an extended pressing nip zone;

said single pressing roll and said pressing shoe cooperating during operation of said twin-wire papermaking machine in such a manner that said paper web is dewatered as it is passed through said extended pressing nip zone formed by said single pressing role and said pressing shoe;

a drying section following said single pressing roll;

said drying section comprising a first drying cylinder and a predetermined number of further drying cylinders;

said first drying cylinder following said single pressing roll and receiving from said single pressing roll said paper web from said extended pressing nip zone; and said first drying cylinder of said drying section is arranged substantially directly below said pressing section.

2. The twin-wire papermaking machine as defined in claim 1, wherein:

said first drying cylinder of said drying section is arranged adjacent said bottom wire.

3. The twin-wire papermaking machine as defined in claim 1, further including:

a steam box operatively associated with said upwardly directed top wire section; and said steam box being arranged intermediate said separating means and said single pressing roll and on a side of said upwardly directed top wire section at which said paper web is entrained substantially in said upward direction.

4. The twin-wire papermaking machine as defined in claim 3, further including:

at least one suction box operatively associated with said upwardly directed top wire section; and said at least one suction box being arranged substantially at the level of said steam box and on a side of said upwardly directd top wire section which is remote from said steam box.

5. The twin-wire papermaking machine as defined in claim 1, wherein:

said separating means for separating said top wire and said bottom wire contain a displaceable wire separation control roll;

said at least one dewatering roll constituting a predetermined number of web forming rolls;

said predetermined number of web forming rolls being arranged in a sequence and containing a last web forming roll of said sequence; and said displaceable wire separation control roll following said last web forming roll of said sequence formed by said predetermined number of web forming rolls.

6. The twin-wire papermaking machine as defined in claim 1, further including:

a displaceable control roll arranged inside said enless loop of said top wire;

said displaceable control roll directly following said predetermined paper web transfer location; and said displaceable controll roll acting upon said top wire and assisting in the transfer of said paper web from said upwardly directed top wire section to said single pressing roll at said predetermined paper web transfer location.

7. The twin-wire papermaking machine as defined in claim 1, further including:

a transfer roll arranged inside said endless loop of said top wire at said upwardly directed top wire section opposite to said predetermined paper web transfer location for separating said paper web from said upwardly directed top wire section and transferring said paper web to said single pressing roll at said predetermined paper web transfer location.

8. The twin-wire papermaking machine as defined in claim 1, further including:

a felt web provided in said extended pressing nip zone and possessing a side facing said paper web located on said single pressing roll; and said felt web pressing said paper web against said smooth circumferential surface of said single pressing roll substantially only in said extended pressing nip zone.

9. The twin-wire papermaking machine as defined in claim 8, further including:

a further felt web wrapped around at least a part of said smooth circumferential surface of said single pressing roll and forming a paper web receiving surface at said part of said smooth circumferential surface of said single pressing roll.

10. The twin-wire papermaking machine as defined in claim 1, further including:

a flexible band guidable through said extended pressing nip zone between said pressing shoe and said single pressing roll and guiding said paper web through said extended pressing nip zone formed by said single pressing roll and said pressing shoe.

11. The twin-wire papermaking machine as defined in claim 8, further including:

a flexible band guidable through said extended pressing nip zone between said pressing shoe and said felt web and coacting with said felt web in order to guide said paper web through said extended pressing nip zone formed by said single pressing roll and said pressing shoe.

12. The twin-wire papermaking machine as defined in claim 9, further including:

a flexible band guidable through said extended pressing nip zone between said pressing shoe and said felt web and coacting with said felt web in order to guide said paper web through said extended pressing nip zone formed by said single pressing roll and said pressing shoe.

13. The twin-wire papermaking machine as defined in claim 1, wherein:

said pressing shoe constitutes a supporting shoe; and said supporting shoe comprises at least one supporting element containing a hydrostatic bearing surface.

14. The twin-wire papermaking machine as defined in claim 13, wherein:

said supporting shoe is constructed to provide a predetermined contact pressure between said paper web and said single pressing roll; and said extended pressing nip zone defining a predetermined passage for said paper web.

15. The twin-wire papermaking machine as defined in claim 1, further including:

a take-off roll following said single pressing roll for taking off said paper web from said smooth circumferential surface of said single pressing roll and for passing-on said paper web to said drying section after said paper web has been taken off from said single pressing roll.

16. The twin-wire papermaking machine as defined in claim 1, wherein:

said at least one dewatering roll which guides said twin-wire section, constitutes at least one web forming roll; and said at least one web forming roll being structured as a non-suction roll.

17. The twin-wire papermaking machine as defined in claim 16, wherein:

said at least one web forming roll constitutes at least two web forming rolls guiding said twin wire section; and said at least two web forming rolls defining a serpentine travel path for said paper web.

18. A method of dewatering a paper web in a twin-wire papermaking machine, comprising the steps:

forming an endless loop of a top wire and an endless loop of a bottom wire in a dewatering section of the papermaking machine;

guiding each said endless loop formed by said top wire and formed by said bottom wire at related guide rolls such that a common twin-wire section is formed;

guiding said twin-wire section along at least one dewatering roll of said dewatering section;

forming a water-containing paper web at said twin-wire section;

separating said top wire and said bottom wire of said twin-wire section at a predetermined wire separating location;

after separating said top wire and said bottom wire, guiding said separated top wire such that an upwardly directed top wire section extends substantially in an upward direction;

entraining said paper web by said upwardly directed top wire section substantially in said upward direction when separating said top wire and said bottom wire at said predetermined separating location;

forming a pressure section containing a single pressing roll which constitutes a non-suction roll possessing a smooth circumferential surface and arranging said single pressing roll following said separating location;

substantially directly transferring said paper web from said upwardly directed top wire section to said single pressing roll at a predetermined paper web transfer location;

forming an extended pressing nip zone by arranging a pressing shoe of said pressing section such as to extend along part of said smooth circumferential surface of said single pressing roll;

passing said paper web through said extended pressing nip zone and thereby dewatering said paper web;

said stem of transferring said paper web from said upwardly directed top wire section to said single pressing roll at said paper web transfer location entailing direct transfer of said paper web to said single pressing roll;

arranging consecutively to said pressing section a drying section containing a first drying cylinder and a predetermined number of further drying cylinders;

after passing said paper web through said extended pressing nip zone, feeding said dewatered paper web to said drying section;

arranging said first drying cylinder of said drying section substantially directly below said pressing section; and said step of feeding said dewatered paper web to said drying section entailing downwardly passing said dewatered paper web from said single pressing roll to said first drying cylinder of said drying section.

19. The method as defined in claim 18, wherein:

said step of feeding said dewatered paper web to said drying section entails feeding said dewatered paper web to said first drying cylinder of said drying section arranged adjacent to said bottom wire.

20. The method as defined in claim 18, further including the steps of:

arranging a steam box intermediate said separating means and said single pressing roll on a side of said upwardly directed top wire section which entrains said paper web substantially in said upward direction; and after entraining said paper web by said upwardly directed top wire section and prior to transferring said paper web from said upwardly directed top wire section to said single pressing roll at said paper web transfer location, exposing said paper web to the action of steam generated in the steam box.

21. The method as defined in claim 20, further including the step of:

during said step of exposing said paper web which is entrained by said upwardly directed top wire section, to the action of steam generated by said steam box, exposing said paper web to the action of a suction box arranged at the level of said steam box and on a side of said upwardly directed top wire section which is remote from said steam box.

22. The method as defined in claim 18, further including the steps of:

providing a predetermined number of dewatering rolls which constitute a predetermined number of web forming rolls arranged in a sequence defining a last one of said web forming rolls; and said step of separating said top wire and said bottom wire of said twin-wire section at said predetermined wire-separating location entails the step of displacing in a controlled manner a displaceable wire separation control roll arranged consecutive to said last web forming roll.

23. The method as defined in claim 18, further including the steps of:

providing a displaceable control roll acting upon said top wire; and said step of transferring said paper web from said upwardly directed top wire section to said single pressing roll at said predetermined paper web transfer location entails the step of controlling the transfer of said paper web by diplacing said displaceable control roll in a controlled manner.

24. The method as defined in claim 18, further including the steps of:

providing a transfer roll cooperating with said single pressing roll at said predetermined paper web transfer location; and said step of transferring said paper web from said upwardly directed top wire section to said single pressing roll at said predetermined paper web transfer location entailing the step of transferring said paper web under the cooperating action of said transfer roll and said single pressing roll.

25. The method as defined in claim 18, further including the steps of:

providing a felt web in said extended pressing nip zone; and during said step of passing said paper web through said extended pressing nip zone, contacting said paper web with said felt web substantially only in said extended pressing nip zone.

26. The method as defined in claim 25, further including the steps of:

providing a further felt web extending around at least part of said smooth circumferential surface of said pressing roll and through said extended pressing nip zone formed by said single pressing roll and said pressing shoe; and during said step of passing said paper web through said extended pressing nip zone, contacting said paper web and said further felt web along said smooth circumferential surface of said single pressing roll.

27. The method as defined in claim 18, further including the steps of:

providing a flexible band in said pressing nip zone; and during said step of passing said paper web through said extended pressing nip zone, passing said paper web conjointly with said flexible band through said extended pressing nip zone.

28. The method as defined in claim 25, further including the steps of:

providing a flexible band in said extended pressing nip zone; and during said step of passing said paper web through said pressing nip zone, passing said paper web conjointly with said flexible band through said extended pressing nip zone.

29. The method as defined in claim 26, further including the steps of:

providing a flexible band in said extended pressing nip zone; and during said step of passing said paper web through said extended pressing nip zone, passing said paper web conjointly with said flexible band through said extended pressing nip zone.

30. The method as defined in claim 18, further including the steps of:

providing as said pressing shoe, a supporting shoe comprising a predetermined number of supporting elements possessing hydrostatic bearing surfaces; and said step of passing said paper web through said extending pressing nip zone, entailing the step of exerting a predetermined contact pressure on said paper web against said smooth circumferential surface of said single pressing roll by means of said predetermined number of supporting elements.

31. The method as defined in claim 30, wherein:

said step of passing said paper web through said extended pressing nip zone includes the step of passing said paper web in a predetermined passage direction through said extended pressing nip zone and increasing in said passage direction of said paper web said contact pressure exerted by said supporting elements on said paper web against said smooth circumferential surface of said single pressing roll.

32. The method as defined in claim 18, further including the steps of:

providing a take-off roll intermediate said single pressing roll and said drying section;

after passing said paper web through said pressing nip zone, using said take-off roll for taking-off said paper web from said single pressing roll; and said step of feeding said dewatered paper web to said drying section entails the step of using said take-off roll for feeding said dewatered paper web from said single pressing roll to said drying section.

33. The method as defined in claim 18, further including the steps of:

selecting as said at least one dewatering roll, at least one web forming roll; and structuring said at least one web forming roll as a non-suction web forming roll.

34. The method as defined in claim 33, further including the steps of:

selecting as said at least one web forming roll, at least two web forming rolls; and arranging said at least two web forming rolls such that said water containing paper web, after infeeding the water containing paper web into said twin-wire section, travels along a serpentine travel path.

35. The papermaking machine as defined in claim 1, further including:

a common roll frame; and said common roll frame supporting said twin-wire section, said pressing section and said drying section of said papermaking machine.

36. The papermaking machine as defined in claim 1, wherein:

said pressing section being arranged at a predetermined elevated level relative to said dewatering section and said drying section; and said paper web being guided through a substantially vertically extending and substantially half-loop defined by said upwardly directed top wire section, said pressing section and said first drying cylinder of said drying section.

37. The method as defined in claim 18, wherein:

said steps of forming said water-containing web at said twin-wire section in said dewatering section, passing said paper web through said extended pressing nip zone of said pressing section and feeding said dewatered paper to said drying section entails passing said paper web through said dewatering section and said pressing section to said drying section and which dewatering section, pressing section and drying section are arranged at a common roll frame.

38. The method as defined in claim 21, further including the steps of:

arranging said pressing section at an elevated level relative to said dewatering section and said drying section; and guiding said paper web through a substantially vertically extending and substantially half-loop defined by said upwardly directed top wire section, said pressing section and said first drying cylinder of said drying section.

* * * * *

UNITED STATES PATENT AND TRADEMARK OFFICE

CERTIFICATE OF CORRECTION

PATENT NO. : 4,662,992

DATED : May 5, 1987

INVENTOR(S) : PETER MIRSBERGER

It is certified that error appears in the above-identified patent and that said Letters Patent is hereby corrected as shown below:

Column 3, Line 68, before "pressing" please delete "the"

Column 4, Line 1, at the beginning of Line 1 please delete "which constitutes" and insert --constituting--

Column 7, Line 16, after "formed" please delete "whch" and insert --which--

Column 7, Line 45, after "pressing" please delete "show" and insert --shoe--

Column 8, Line 41, after "displaceable" please delete "controll" and insert --control--

Column 9, Line 29, after "shoe" please delete "comprises" and insert --comprising--

Column 9, Line 39, after "passage" please insert --direction--

Column 10, Line 34, after "said" (in the first instance) please delete "stem" and insert --step--

Column 11, Line 34, before "said" (in the second instance) please delete "diplacing" and insert --displacing--

UNITED STATES PATENT AND TRADEMARK OFFICE

CERTIFICATE OF CORRECTION

PATENT NO. : 4,662,992

DATED : May 5, 1987

INVENTOR(S) : Peter Mirsberger

It is certified that error appears in the above-identified patent and that said Letters Patent is hereby corrected as shown below:

Column 14, line 5, after "paper" insert -- web --.

Signed and Sealed this

Tenth Day of November, 1987

*Attest:*

DONALD J. QUIGG

*Attesting Officer*

*Commissioner of Patents and Trademarks*